US011603973B2

(12) United States Patent
Han et al.

(10) Patent No.: US 11,603,973 B2
(45) Date of Patent: Mar. 14, 2023

(54) LAMP FOR VEHICLE AND VEHICLE INCLUDING IHE SAME

(71) Applicants: HYUNDAI MOBIS CO., LTD., Seoul (KR); ETENDUE LIGHTING CO., LTD., Bucheon-si (KR)

(72) Inventors: Gil Won Han, Yongin-si (KR); Sun Gu Kang, Bucheon-si (KR); So Young Lee, Seoul (KR)

(73) Assignees: HYUNDAI MOBIS CO., LTD., Seoul (KR); ETENDUE LIGHTING CO., LTD., Bucheon-si (KR)

( * ) Notice: Subject to any disclaimer, the term of this patent is extended or adjusted under 35 U.S.C. 154(b) by 0 days.

(21) Appl. No.: 17/489,521

(22) Filed: Sep. 29, 2021

(65) Prior Publication Data

US 2022/0403995 A1 Dec. 22, 2022

(30) Foreign Application Priority Data

Jun. 22, 2021 (KR) ..... 10-2021-0081135

(51) Int. Cl.
*F21S 41/265* (2018.01)
*F21S 41/143* (2018.01)

(52) U.S. Cl.
CPC ..... *F21S 41/265* (2018.01); *F21S 41/143* (2018.01)

(58) Field of Classification Search
CPC ..... F21S 41/265; F21S 41/143
See application file for complete search history.

(56) References Cited

U.S. PATENT DOCUMENTS 9,964,274 B2 * 5/2018 Lin ..... F21S 41/33
10,352,518 B2 * 7/2019 Lee ..... F21S 41/265

FOREIGN PATENT DOCUMENTS

| | | |
|---|---|---|
| JP | 2004-152764 | 5/2004 |
| JP | 2008-532250 | 8/2008 |
| JP | 2021-504911 | 2/2021 |
| KR | 2019-0006311 | 1/2019 |
| KR | 2019-0081690 | 7/2019 |

OTHER PUBLICATIONS

Korean Office Action dated Jan. 16, 2023 issued in KR Application No. 10-2021-0081135.
English Language Abstract of JP 2004-152764 published May 27, 2004.

(Continued)

*Primary Examiner* — Matthew J. Peerce
(74) *Attorney, Agent, or Firm* — DLA Piper LLP (US)

(57) ABSTRACT

Disclosed is a lamp for a vehicle, the lamp including: a light source unit configured to emit light forward; a collimator which is provided in front of the light source unit and on which the light emitted from the light source unit is incident; and a multi facet lens (MFL) which is provided in front of the collimator and on which the light emitted from the collimator is incident. The MFL includes: a plurality of facets; and stepped portions, which are provided between the plurality of facets and each of which connects the two neighboring facets. At least some of exit surfaces of the plurality of facets are perpendicular to the ground or have shapes inclined upward in a forward direction.

10 Claims, 3 Drawing Sheets

(56) References Cited

OTHER PUBLICATIONS

English Language Abstract of JP 2008-532250 published Aug. 14, 2008.
English Language Abstract of JP 2021-504911 published Feb. 15, 2021.
English Language Abstract of KR 2019-0006311 published Jan. 18, 2019.
English Language Abstract of KR 2019-0081690 published Jul. 9, 2019.

* cited by examiner

LAMP FOR VEHICLE AND VEHICLE INCLUDING IHE SAME

CROSS-REFERENCE TO RELATED APPLICATION(S)

This application claims priority from and the benefit of Korean Patent Application No. 10-2021-0081135, filed on Jun. 22, 2021, which is hereby incorporated by reference for all purposes as if set forth herein.

TECHNICAL FIELD

Exemplary embodiments relate to a lamp for a vehicle and a vehicle including the lamp and, more particularly, to a lamp for a vehicle, which is equipped with an MFL, and a vehicle including the lamp.

BACKGROUND

Recently, as the demands for aesthetic impression of the exterior of a vehicle increase, the demands for aesthetic impression of an image formed when a lamp for a vehicle is turned on also increase. In order to satisfy these demands, researches on a lamp for a vehicle, to which a multi facet lens (MFL) is mounted, have been actively performed.

Compared to a typical aspherical lens, the MFL, which has a structure in which regions having a plurality of facets are integrally formed, has significantly excellent aesthetic impression when the lamp is turned on.

However, according to the related art, some light is emitted, while being refracted upward, in stepped regions of boundaries between the plurality of facets. This causes a glare phenomenon and produces glare in the eyes of pedestrians or other drivers.

SUMMARY

Exemplary embodiments of the present invention provide for minimizing a glare phenomenon in a lamp for a vehicle equipped with a MFL, thereby improving performance of the lamp for a vehicle.

A first exemplary embodiment of the present invention provides a lamp for a vehicle, the lamp including: a light source unit configured to emit light forward; a collimator which is provided in front of the light source unit and on which the light emitted from the light source unit is incident; and a multi facet lens (MFL) which is provided in front of the collimator and on which the light emitted from the collimator is incident. The MFL includes: a plurality of facets; and stepped portions, which are provided between the plurality of facets and each of which connects the two neighboring facets. At least some of exit surfaces of the plurality of facets are perpendicular to the ground or have shapes inclined upward in a forward direction.

The MFL may be spaced apart from the collimator in the forward direction.

The light, which is incident on the collimator after being emitted from the light source unit, may move downward while emitted from the collimator.

The light, which is emitted to the outside via the collimator and the MFL after being emitted from the light source unit, may form a low beam pattern.

The MFL may further include curved regions, each of which is provided between the stepped portion and the facet to connect the stepped portion to the facet and has a predetermined radius of curvature, and the light, which is incident on the curved region after being emitted from the light source unit, may move downward while emitted.

All of the exit surfaces of the plurality of facets provided in the MFL may be perpendicular to the ground or have shapes inclined upward in the forward direction.

The lamp may further include a housing configured to accommodate the light source unit, the collimator, and the MFL. The housing may include: a first region which has a first width (W1) and a first height (H1), and has a space formed therein to accommodate the light source unit; and a second region which has a second width (W2) less than the first width and a second height (H2) less than the first height, and has a space formed therein to accommodate the collimator and the MFL.

A distance between the light source unit and the collimator may be greater than a distance between the collimator and the MFL.

At least some of the plurality of stepped portions provided between the plurality of facets may be parallel to the ground or have shapes inclined downward in the forward direction.

All of the plurality of stepped portions provided between the plurality of facets may be parallel to the ground or have shapes inclined downward in the forward direction.

A second exemplary embodiment of the present invention provides a vehicle including a lamp for a vehicle. The lamp includes: a light source unit configured to emit light forward; a collimator which is provided in front of the light source unit and on which the light emitted from the light source unit is incident; and a multi facet lens (MFL) which is provided in front of the collimator and on which the light emitted from the collimator is incident. The MFL includes: a plurality of facets; and stepped portions, which are provided between the plurality of facets and each of which connects the two neighboring facets. At least some of exit surfaces of the plurality of facets are perpendicular to the ground or have upper regions inclined in a forward direction.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Hereinafter, a lamp for a vehicle and the vehicle according to the present disclosure will be described with reference to the drawings.

Lamp for Vehicle

Figure 1:
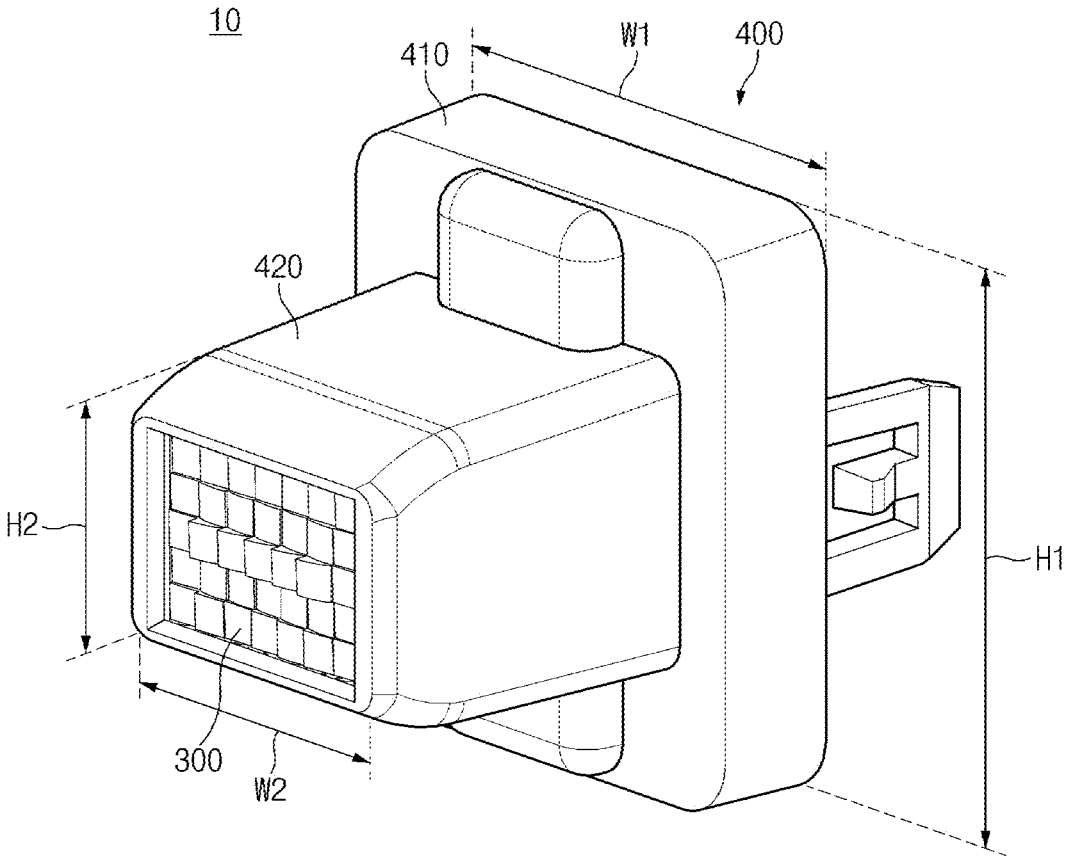
FIG. 1 is a perspective view illustrating a structure of a lamp for a vehicle according to the present disclosure.
Figure 2:
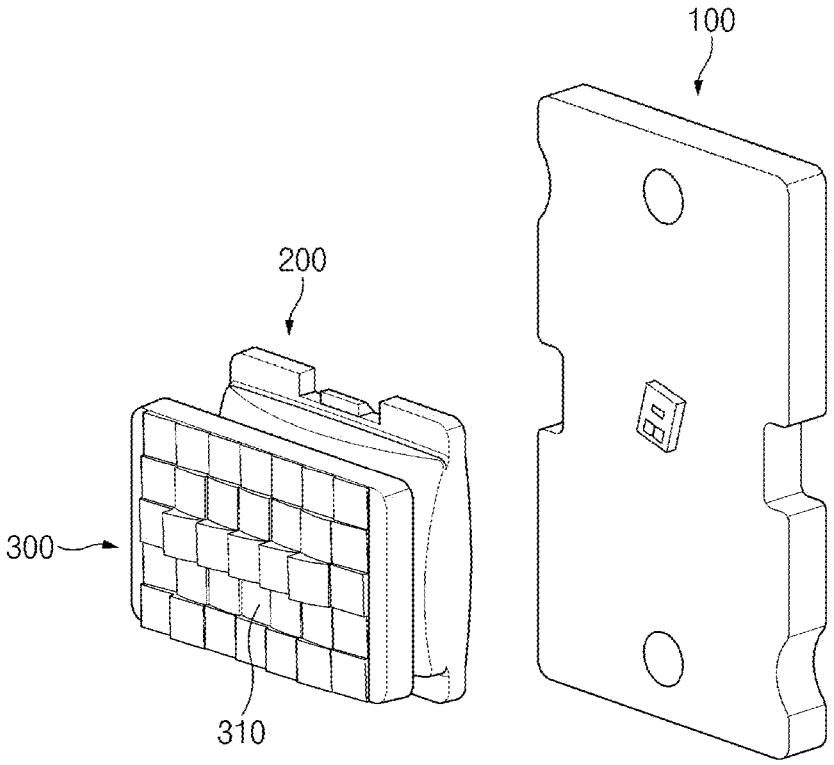
FIG. 2 is a perspective view illustrating a state in which a housing is removed from a lamp for a vehicle according to the present disclosure.
Figure 3:
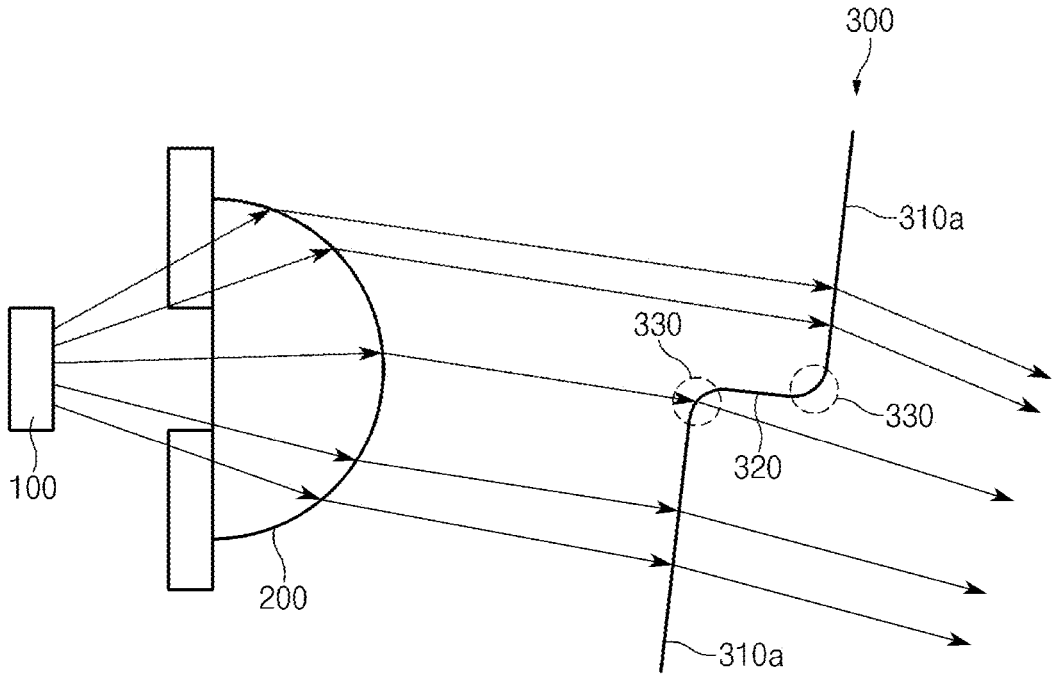
FIG. 3 is a cross-sectional side view showing an arrangement relationship between a light source unit, a collimator, and an MFL and a movement path of light in a lamp for a vehicle according to the present disclosure.

FIG. 1 is a perspective view illustrating a structure of a lamp for a vehicle according to the present disclosure, and FIG. 2 is a perspective view illustrating a state in which a housing is removed from a lamp for a vehicle according to the present disclosure. FIG. 3 is a cross-sectional side view showing an arrangement relationship between a light source unit, a collimator, and an MFL and a movement path of light in a lamp for a vehicle according to the present disclosure.

Referring to FIGS. 1 to 3, a lamp 10 for a vehicle (hereinafter, referred to as a 'lamp') according to the present disclosure may include a light source unit 100 that emits light forward. The light source unit 100 may include a substrate and a light source such as an LED fixed on the front side of the substrate.

The lamp 10 may further include a collimator 200 which is provided in front of the light source unit 100 and on which the light emitted from the light source unit 100 is incident. The collimator 200 may be configured to convert the light, which has been emitted from the light source unit 100, into parallel light.

Also, the lamp 10 may further include a multi facet lens (MFL) 300 which is provided in front of the collimator 200 and on which the light emitted from the collimator 200 is incident. The MFL 300 includes: a plurality of facets 310; stepped portions 320, which are provided between the plurality of facets 310 and each of which connects the two neighboring facets 310; and curved regions 330, each of which is provided between the stepped portion 320 and the facet 310 to connect the stepped portion 320 to the facet 310 and has a predetermined radius of curvature.

According to the present disclosure, the light emitted from the light source unit 100 arrives at the MFL 300 via the collimator 200, and is then transmitted through the plurality of facets 310 and emitted to the outside, and accordingly, a predetermined beam pattern may be formed. In particular, according to the present disclosure, unit beam patterns formed by light emitted from the respective facets 310 may be combined together to form a single beam pattern.

As one example, according to the present disclosure, the light, which is emitted to the outside via the collimator 200 and the MFL 300 after being emitted from the light source unit 100, may forms a low beam pattern. That is, the lamp 10 for a vehicle according to the present disclosure may be a head lamp for a low beam.

Meanwhile, according to the related art, while the light is emitted to the outside via the MFL, some light is emitted upward. Unlike the light emitted downward and arriving at the ground, the light emitted upward arrives at the eyes of pedestrians or drivers of other vehicles and causes glare in the eyes of the pedestrians or drivers of other vehicles.

According to the present disclosure for solving the above limitation, at least some of exit surfaces 310*a* of the plurality of facets 310 may be perpendicular to the ground or have shapes inclined upward in a forward direction. More preferably, all of the exit surfaces 310*a* of the plurality of facets 310 provided in the MFL 300 of the lamp 10 according to the present disclosure may i) be perpendicular to the ground or ii) have shapes inclined upward in the forward direction. As one example, FIG. 3 illustrates a state in which the exit surface 310*a* of the facet 310 has a shape inclined upward in the forward direction.

According to the related art, in a lamp provided with an MFL, light causing glare in the eyes, particularly, light emitted upward to the outside is usually produced from the light passing through curved regions that connect a plurality of facets and stepped portions. This is because the curved regions are formed protruding relatively upward.

However, according to the present disclosure, the exit surfaces 310*a* of the plurality of facets 310 are perpendicular to the ground or have shapes inclined upward in the forward direction, and thus the curved regions 330 formed between the plurality of facets 310 and the stepped portions 320 are formed protruding relatively downward. Thus, the light, which is incident on the curved region 330 after being emitted from the light source unit 100, may move downward while emitted.

Also, according to the present disclosure, at least some of the plurality of stepped portions 320 provided between the plurality of facets 310 may be parallel to the ground or have shapes inclined downward in the forward direction. More preferably, all of the plurality of stepped portions 320 provided in the MFL 300 of the lamp 10 according to the present disclosure may i) be parallel to the ground or ii) have shapes inclined downward in the forward direction. As one example, FIG. 3 illustrates a state in which the stepped portion 320 has a shape inclined downward in the forward direction.

Meanwhile, according to the present disclosure as illustrated in FIG. 3, the light, which is incident on the collimator 200 after being emitted from the light source unit 100, may move downward while emitted from the collimator 200. More specifically, the light, which is incident on the collimator 200 from the light source unit 100, may be emitted in the form of downward parallel light and then arrive at the MFL 300.

Meanwhile, according to the present disclosure, the MFL 300 may be spaced apart from the collimator 200 in the forward direction. According to the present disclosure, since the MFL 300 is spaced apart from the collimator 200, there is no need to directly couple and assemble the MFL 300 and the collimator 200 during a process for manufacturing the lamp 10. Thus, since regions required to assemble the MFL 300 and the collimator 200 are removed from the MFL 300 and the collimator 200, the overall volume occupied by the lamp 10 may be significantly reduced, and the effect of tolerance of the MFL 300 and the collimator 200 on the performance of the lamp 10 when the MFL 300 and the collimator 200 are directly coupled may be significantly reduced.

Continuing to refer to FIG. 1, the lamp 10 according to the present disclosure may further include a housing 400 that accommodates the light source unit 100, the collimator 200, and the MFL 300.

The housing 400 may have a stepped structure. More specifically, the housing 400 may include: a first region 410 which has a first width W1 and a first height H1, and has a space formed therein to accommodate the light source unit 100; and a second region 420 which has a second width W2 less than the first width W1 and a second height H2 less than the first height H1, and has a space formed therein to accommodate the collimator 200 and the MFL 300. Thus, a stepped portion may be formed between the first region 410 and the second region 420.

Meanwhile, according to the present disclosure as illustrated in FIG. 2, a distance between the light source unit 100 and the collimator 200 may be greater than a distance between the collimator 200 and the MFL 300.

Vehicle

A vehicle according to the present disclosure may include a lamp 10 for a vehicle.

The lamp 10 may include: a light source unit 100 which emits light forward; a collimator 200 which is provided in front of the light source unit 100 and on which the light emitted from the light source unit 100 is incident; and a multi facet lens (MFL) 300 which is provided in front of the collimator 200 and on which the light emitted from the collimator 200 is incident. The MFL 300 includes a plurality of facets 310; and stepped portions 320, which are provided between the plurality of facets 310 and each of which connects the two neighboring facets 310.

Here, according to the present disclosure, at least some of exit surfaces 310*a* of the plurality of facets 310 may be perpendicular to the ground or have upper regions inclined in a forward direction. Meanwhile, detailed description of the lamp provided in the vehicle according to the present disclosure will be substituted by the earlier description of the lamp according to the present disclosure.

According to the present disclosure, the glare phenomenon may be minimized to enhance the performance of the lamp for a vehicle.

Although the present disclosure has been described with specific exemplary embodiments and drawings, the present disclosure is not limited thereto, and it is obvious that various changes and modifications may be made by a person skilled in the art to which the present disclosure pertains within the technical idea of the present disclosure and equivalent scope of the appended claims.

What is claimed is:

1. A lamp for a vehicle, the lamp comprising:

a light source unit configured to emit light forward;

a collimator which is provided in front of the light source unit and on which the light emitted from the light source unit is incident; and a multi facet lens (MFL) which is provided in front of the collimator and on which the light emitted from the collimator is incident, wherein the MFL comprises:

a plurality of facets; and a plurality of stepped portions, which are provided between the plurality of facets and each of which connects two neighboring facets of the plurality of facets, wherein at least some of exit surfaces of the plurality of facets are perpendicular to the longitudinal axis of the vehicle or have shapes inclined upward in a forward direction, wherein the MFL further comprises a plurality of curved regions, each of which is provided between a respective stepped portion of the plurality of stepped portions and a respective facet of the plurality of facets to connect the respective stepped portion to the respective facet and has a predetermined radius of curvature, and the light which is incident on the curved region after being emitted from the light source unit moves downward with respect to the longitudinal axis of the vehicle while emitted.

2. The lamp of claim 1, wherein the MFL is spaced apart from the collimator in the forward direction.

3. The lamp of claim 1, wherein the light which is incident on the collimator after being emitted from the light source unit moves downward with respect to the longitudinal axis of the vehicle while emitted from the collimator.

4. The lamp of claim 1, wherein the light which is emitted to the outside via the collimator and the MFL after being emitted from the light source unit forms a low beam pattern.

5. The lamp of claim 1, wherein all of the exit surfaces of the plurality of facets provided in the MFL are perpendicular to the longitudinal axis of the vehicle or have shapes inclined upward in the forward direction.

6. The lamp of claim 1, further comprising a housing configured to accommodate the light source unit, the collimator, and the MFL, wherein the housing comprises:

a first region which has a first width and a first height, and has a space formed therein to accommodate the light source unit; and a second region which has a second width less than the first width and a second height less than the first height, and has a space formed therein to accommodate the collimator and the MFL.

7. The lamp of claim 1, wherein a distance between the light source unit and the collimator is greater than a distance between the collimator and the MFL.

8. The lamp of claim 1, wherein at least some of the plurality of stepped portions provided between the plurality of facets are parallel to the longitudinal axis of the vehicle or have shapes inclined downward with respect to the longitudinal axis of the vehicle in the forward direction.

9. The lamp of claim 1, wherein all of the plurality of stepped portions provided between the plurality of facets are parallel to the longitudinal axis of the vehicle or have shapes inclined downward with respect to the longitudinal axis of the vehicle in the forward direction.

10. A vehicle comprising a lamp for a vehicle, wherein the lamp comprises:

a light source unit configured to emit light forward;

a collimator which is provided in front of the light source unit and on which the light emitted from the light source unit is incident; and a multi facet lens (MFL) which is provided in front of the collimator and on which the light emitted from the collimator is incident, wherein the MFL comprises:

a plurality of facets; and a plurality of stepped portions, which are provided between the plurality of facets and each of which connects two neighboring facets of the plurality of facets, wherein at least some of exit surfaces of the plurality of facets are perpendicular to the longitudinal axis of the vehicle or have upper regions inclined in a forward direction, wherein the MFL further comprises a plurality of curved regions, each of which is provided between a respective stepped portion of the plurality of stepped portions and a respective facet of the plurality of facets to connect the respective stepped portion to the respective facet and has a predetermined radius of curvature, and the light which is incident on the curved region after being emitted from the light source unit moves downward with respect to the longitudinal axis of the vehicle while emitted.

* * * * *